US005134383A

United States Patent [19]

Ueda

[11] Patent Number: 5,134,383

[45] Date of Patent: Jul. 28, 1992

[54] VARIABLE RESISTOR

[75] Inventor: Yukinori Ueda, Nagaokakyo, Japan

[73] Assignee: Murata Manufacturing Co., Ltd., Kyoto, Japan

[21] Appl. No.: 635,705

[22] Filed: Dec. 28, 1990

[30] Foreign Application Priority Data

Dec. 28, 1989 [JP] Japan ..... 1-341295

[51] Int. Cl.[5] ..... H01C 10/32

[52] U.S. Cl. ..... 338/162; 338/163; 338/167; 338/168; 338/170

[58] Field of Search ..... 338/162, 163, 164, 167, 338/168, 169, 170

[56] References Cited

U.S. PATENT DOCUMENTS 3,195,092 7/1965 Tumbusch ..... 338/167
3,328,707 6/1967 Louis et al. ..... 338/167
3,432,790 3/1969 Svilpe et al. ..... 338/167
5,047,746 9/1991 Stilwell et al. ..... 338/162

*Primary Examiner*—Marvin M. Lateef
*Attorney, Agent, or Firm*—Wenderoth, Lind & Ponack

[57] ABSTRACT

A variable resistor includes a sliding member having an arm in contact with a substantially circular arc-shaped resistor provided on a substrate and a driver plate portion from which the arm extends. The sliding member is rotatable by a driver, the center of the resistor being a supporting point of the sliding member. The driver plate portion of the sliding member is substantially conical and has driver grooves. The arm is connected to the driver plate portion at both sides of a driver groove adjacent an end of the driver groove. Adjustment of a resistance value is performed by rotating the sliding member with a driver tip inserted in the driver grooves.

4 Claims, 4 Drawing Sheets

VARIABLE RESISTOR

FIELD OF THE INVENTION

The present invention relates to a variable resistor, particularly, to a sliding member to be incorporated in a chip-type semifixed variable resistor.

PRIOR ART

Conventionally, a variety of chip-type semifixed variable resistors have been proposed. However, driver grooves, which allow a sliding member (the driver grooves are formed in the sliding member itself) of such resistors to be rotated with a driver, are as small as 0.5~0.6 mm in width and 2.2~2.6 mm in length, which makes the insertion of the tip of the driver difficult in either case of manual or automatic adjustment, accordingly leading to decreased efficiency of an adjusting operation. Thus, the Applicant of the present invention proposed in Japanese patent application No. 1-137047 a variable resistor, as shown in FIGS. 8 and 9, in which a driver plate 16 of a sliding member 15 is substantially conical and has driver grooves 19 formed therein. Further in this variable resistor, a substantially circular arc-shaped resistor 12 is provided on a substrate 10, and a tubular portion 21 of a collector 20, extending through a central hole 11 of the substrate 10, is caulked so as to rotatably support the sliding member 15. In the sliding member 15, a contact part 17*a* of a circular arc-shaped arm part 17, provided at a part of the outer periphery of the sliding member, is brought into contact with the resistor 12. Reference characters 12*a* and 12*b* denote outside electrodes, and each outside electrode is connected to an end of the resistor 12.

However, due to the further miniaturization of chip-type variable resistors, the ease of adjustment of the variable resistor as illustrated in FIGS. 8 and 9 by means of a driver is reaching the limit. For example, in a chip-type variable resistor of 3 mm in size, as illustrated in FIG. 10, a length L of the driver grooves 19 should be 2.4~2.6 mm so that a driver can be inserted and caught smoothly. However, since a connecting part 18', formed by folding the arm part and the driver plate 16, faces an end of the driver grooves 19, only 0.2~0.3 mm is left for width t1 and t2 of the connecting part 18', which causes problems in that a press process is difficult and sufficient strength cannot be obtained. As a result, as illustrated in FIG. 11, a pair of driver grooves 19*a* must be made shorter or only one pair of driver grooves 19*b* is provided. Thus, the adjustment has become even more difficult.

SUMMARY OF THE INVENTION

An object of the present invention is to provide a variable resistor having a small sliding member in which driver grooves, having the same shape as the conventional ones, are defined without denigrating the ease in which the slider member can be fabricated and the strength of portions thereof at which an arm part and a driver plate are connected.

For the purpose of achieving the above-mentioned object, a variable resistor according to the present invention is characterized in that a driver plate provided with driver grooves and a substantially ring-shaped arm part having a contact part are stamped out of a thin plate as connected with each other at both sides adjacent an end of a driver groove and are folded relative to one another at connected parts by 180°.

In the sliding member as described above, the connecting parts do not face an end of the driver grooves, but are provided opposite one another to both sides of a driver groove. Accordingly, the width of the connecting parts can be secured without being limited by the driver grooves. Thus problems in view of processing and strength can be solved. Needless to say, the driver grooves can be sufficiently large for ensuring the receipt of the driver tip.

Moreover, when the driver plate is formed substantially conical and the driver grooves are provided in the inclined surface thereof, the tip of the adjustment driver is guided by the inclined surface, thus ensuring the insertion of the driver into the driver grooves.

BRIEF DESCRIPTION OF THE DRAWINGS

FIGS. 1 through 3 show a first embodiment of a variable resistor according to the present invention, in which:

FIG. 1 is a plan view;

FIG. 2 is a front view; and

FIG. 3 is a bottom plan view.

FIGS. 4 through 7 show a sliding member employed in the aforementioned variable resistor, in which:

FIG. 4 is a plan view;

FIG. 5 is a front view;

FIG. 6 is a bottom plan view; and

FIG. 7 is a sectional view taken along line A—A of FIG. 4.

DETAILED DESCRIPTION OF THE PREFERRED EMBODIMENTS

The preferred embodiments of a variable resistor according to the present invention will now be described with reference to FIGS. 1 to 7.

Figure 1:
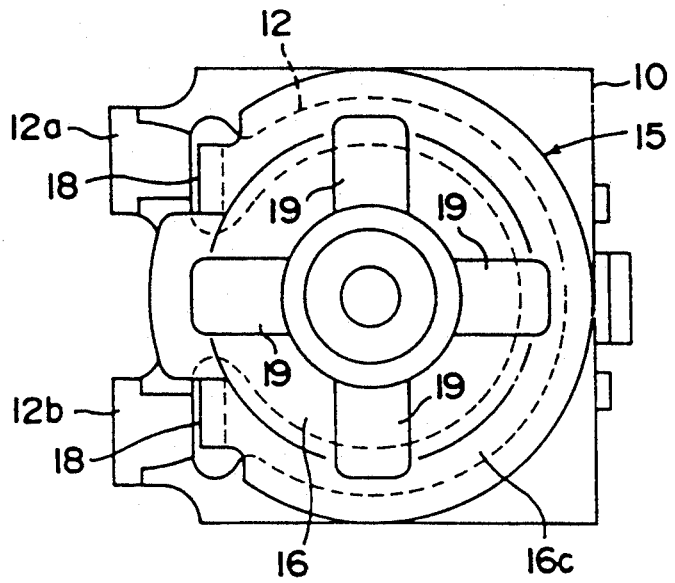
Figure 2:
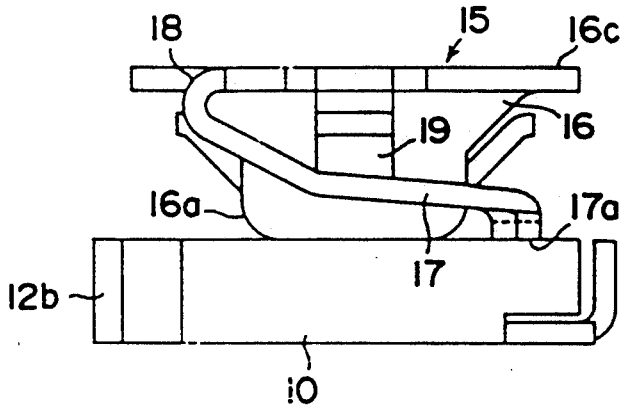
Figure 3:
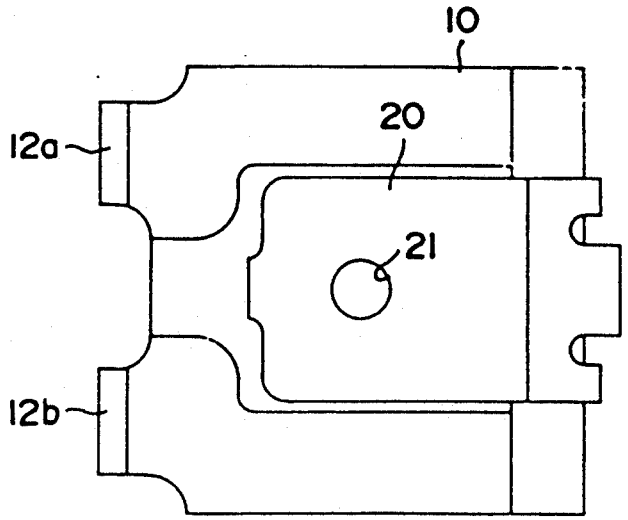
Figure 4:
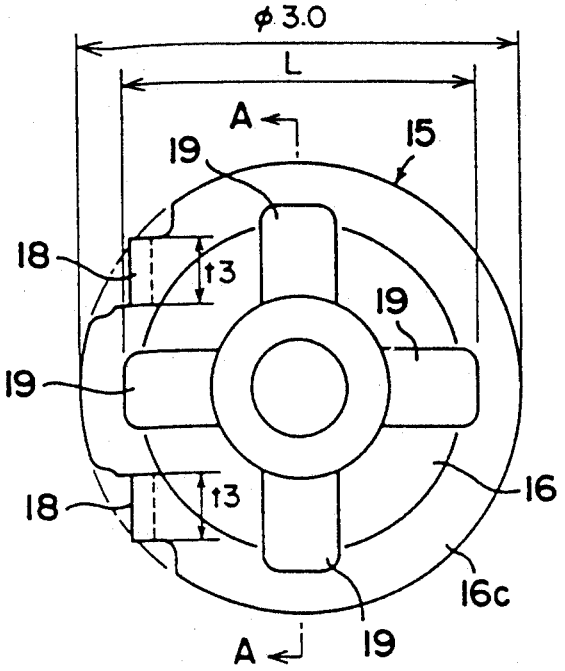
Figure 5:
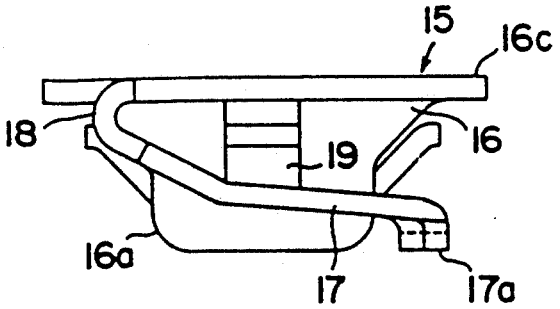
Figure 6:
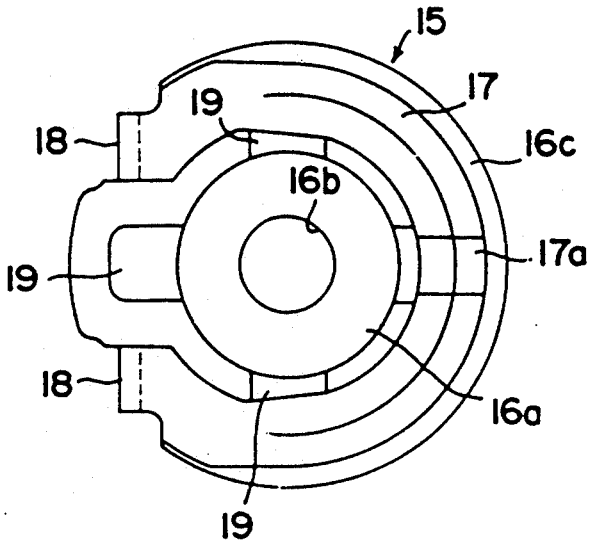
Figure 7:
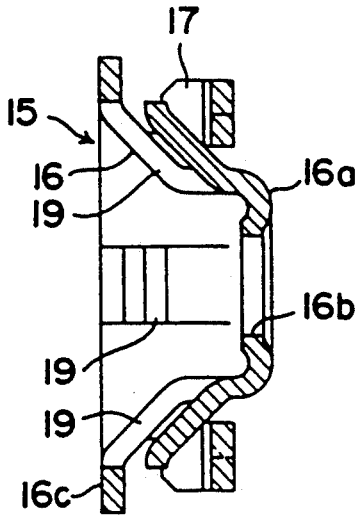
Figure 8:
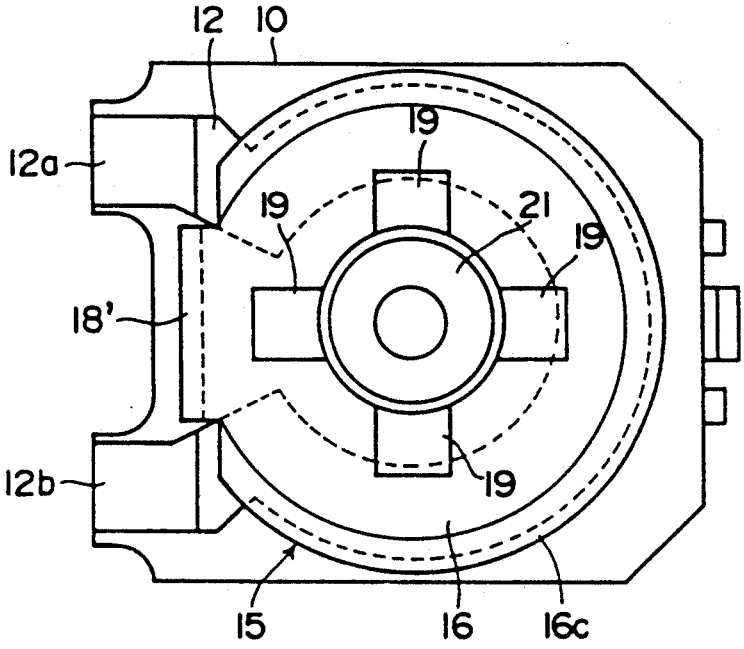
FIG. 8 is a plan view of a variable resistor proposed prior to the present invention.
Figure 9:
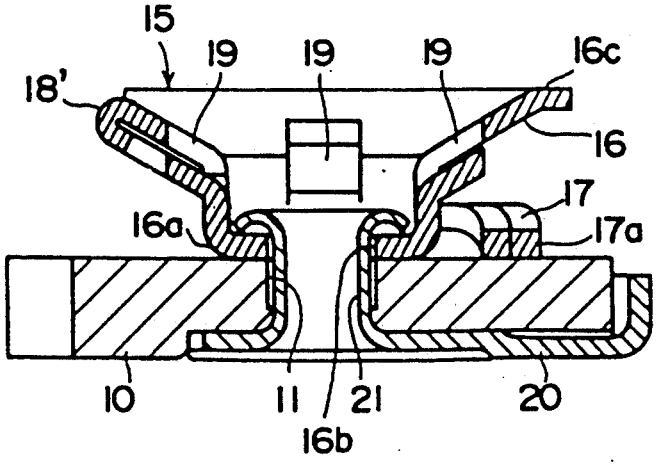
FIG. 9 is a central sectional view of the variable resistor.
Figure 10:
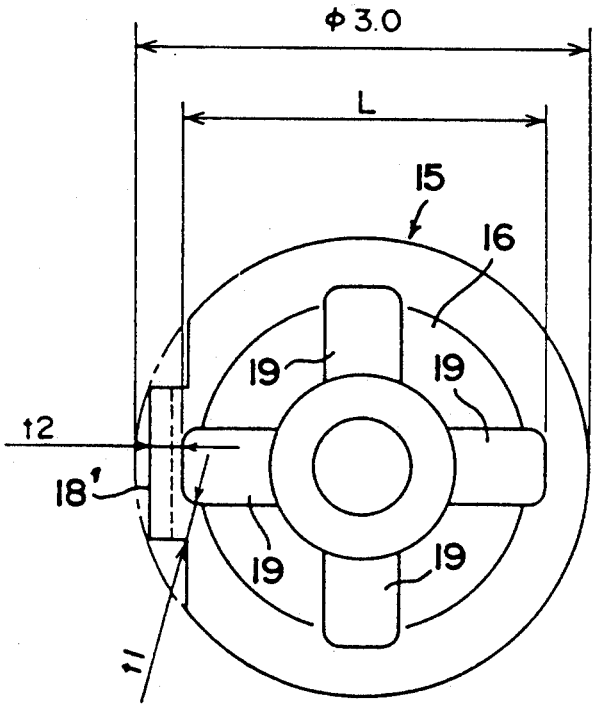
FIG. 10 is a plan view of a sliding member employed in the variable resistor.
Figure 11:
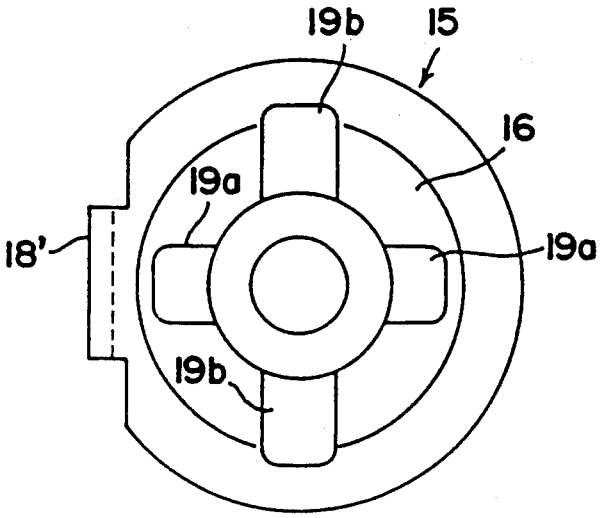
FIG. 11 is a plan view showing another sliding member.

As shown in FIGS. 1, 2 and 3, the variable resistor comprises a substrate 10 having a resistor 12, a sliding member 15, a collector terminal 20 and resistor electrodes 12*a*, 12*b*. The variable resistor is basically of the same construction as the one illustrated in FIGS. 8 and 9. Therefore, identical numerals are used to designate the same members and parts and a detailed description of the substrate 10 will be omitted.

As shown in FIGS. 4 through 7, the sliding member 15 is formed by folding a thin plate to provide a driver plate 16 and an arm part 17 which are overlapped with each other. Namely, the sliding member 15 is fabricated from a conductive thin plate by stamping the plate to provide a substantially dish-like protrusion 16*a* and the substantially ring-shaped arm part 17 having a protruding contact part 17*a* connected with each other, and then by folding the plate at connecting parts 18, 18 by 180°. The protrusion 16*a* protrudes downward below the arm part 17 at the center of the driver plate 16. The driver plate 16 has an outer diameter slightly larger than that of the arm part 17 and is conical. Driver groves 19 of a Phillips head type are formed on the inclined surface of the conical protrusion.

In the present embodiment in particular, the connecting parts 18, 18 are formed at both sides adjacent an end part of a driver groove 19. Accordingly, even when the length L of the driver groove 19 is 2.4~2.6 mm which is satisfactory to keep the driver inserted sufficiently, the width t3 of the connecting parts 18, 18 can be readily provided by a press process and the strength of the connecting parts will be sufficient.

Furthermore, when the sliding member 15 is rotatably mounted on the substrate 10, not only the spring force of the arm part 17, but also that of the connecting parts 18, 18 and the like, act on the contact part 17*a*, which results in the contact part 17*a* being brought into contact with the resistor 12 under a proper spring pressure.

As to the resistance value adjustment, in either automatic or manual adjustment, even if the driver tip deviates from the driver grooves 19, due to the inclined surface of the conical protrusion of the driver plate 16, the driver tip will be inserted into the driver grooves 19 when rotated without the driver tip falling off of the driver plate. In automatic adjustment, therefore, the detection of the position of the driver grooves 19 may be conducted only roughly, and an image recognition device such as a CCD camera and the like for accurately detecting a position is not required. Yet still, when an image recognition device is employed, the driver insertion is remarkably ensured.

Moreover, in this embodiment, the outer periphery of the driver plate 16 of the sliding member 15 is flat (flat part 16*c*). Accordingly, when conveying the variable resistor onto a printed substrate by means of a suction nozzle of a chip placer, contact with the suction nozzle is facilitated by the flat part 16*c*.

The variable resistor according to the present invention is not limited to the examples described above, but can be modified in various ways within the scope of the present invention.

Particularly, the conical configuration of the driver plate 16 is important in facilitating the insertion of the driver in the driver grooves, but it is not necessarily important in view of one object of the present invention which is to provide a variable resistor which may be fabricated easily and which has sufficient strength at the connecting parts 18, 18.

As is clear from the above explanations, according to the present invention, since the driver plate and the arm part are connected with each other at both sides of a driver groove adjacent an end of the driver groove, a comparatively large width of the connecting parts can be provided and accordingly, the lengths of the driver grooves do not have to be shortened, which makes it possible to easily perform a process of forming the connecting parts and to provide a sufficient strength thereof.

What is claimed is:

1. A variable resistor comprising: a substrate; a resistive member extending along a circular arcuate path on a surface of said substrate; and a rotatable sliding member rotatably mounted to said substrate so as to be rotatable about a point corresponding to the center about which said circular arcuate path extends, said sliding member comprising a thin plate of electrically conductive material including a driver plate portion, and a substantially ring-shaped arm connected to said driver plate portion and extending at an inclination from said driver plate portion and into contact with said resistive member, said driver plate portion having a substantially dish-shaped protrusion at the center thereof and defining driver grooves in said protrusion, and said substantially ring-shaped arm being connected to said driver plate portion at two locations adjacent an end of one of said driver grooves and on opposite sides of said one of the driver grooves from one another.

2. A variable resistor as claimed in claim 1, wherein said dish-like protrusion is substantially conical and said driver grooves extend in an inclined surface thereof.

3. A variable resistor as claimed in claim 1, wherein said driver plate portion and said arm are disposed in a superposed overlapping relationship.

4. A variable resistor as claimed in claim 2, wherein said driver plate portion and said arm are disposed is a superposed overlapping relationship.

* * * * *